US009540844B2

(12) United States Patent
Malenkovic et al.

(10) Patent No.: US 9,540,844 B2
(45) Date of Patent: Jan. 10, 2017

(54) LOCK RE-PINNING ASSEMBLY

(71) Applicant: Schlage Lock Company LLC, Indianapolis, IN (US)

(72) Inventors: Peter Malenkovic, Monument, CO (US); James D. Ohl, Colorado Springs, CO (US); Raymond H. Lammers, Colorado Springs, CO (US); Kevin Earl David, Colorado Springs, CO (US)

(73) Assignee: Schlage Lock Company, LLC, Indianapolis, IN (US)

( * ) Notice: Subject to any disclaimer, the term of this patent is extended or adjusted under 35 U.S.C. 154(b) by 109 days.

(21) Appl. No.: 14/659,455

(22) Filed: Mar. 16, 2015

(65) Prior Publication Data

US 2015/0259948 A1 Sep. 17, 2015

Related U.S. Application Data

(60) Provisional application No. 61/953,729, filed on Mar. 14, 2014.

(51) Int. Cl.
*E05B 17/00* (2006.01)
*E05B 27/00* (2006.01)

(52) U.S. Cl.
CPC ..... *E05B 17/0004* (2013.01); *E05B 27/005* (2013.01); *E05B 27/0017* (2013.01); *Y10T 29/49826* (2015.01); *Y10T 70/8432* (2015.04)

(58) Field of Classification Search
CPC ..... E05B 27/0007; E05B 63/0065; E05B 17/0004; E05B 27/0003; E05B 27/0017; E05B 27/005; E05B 19/04; Y10T 29/49826; Y10T 70/8432
USPC ..... 70/490–493, 367–372, 375, 378, 379 R, 70/466, 382, 384
See application file for complete search history.

(56) References Cited

U.S. PATENT DOCUMENTS 3,111,748 A * 11/1963 Doll ..... E05B 17/0004 29/434
3,218,699 A * 11/1965 Maese ..... E05B 17/0004 29/423
3,417,452 A * 12/1968 Roland ..... B21D 53/42 29/436

(Continued)

OTHER PUBLICATIONS

International Search Report and Written Opinion; International Searching Authority/US; International PCT Application No. PCT/US15/20826; Jun. 23, 2015; 6 pages.

*Primary Examiner* — Suzanne Barrett
(74) *Attorney, Agent, or Firm* — Taft Stettinius & Hollister LLP

(57) ABSTRACT

A lock re-pinning assembly including two or more housings and a mounting block. Each housing is configured for use with a corresponding one of a plurality of lock cylinder shells. Each of the housings includes a cylindrical chamber and a channel. The chamber is configured to receive the body of the corresponding shell, and the channel is configured to receive the tower of the corresponding shell. The mounting block includes a mounting block having two or more sections. Each section is configured for use with a corresponding one of a plurality of lock cylinder plugs. Each section includes a cavity configured to receive an end of at least one of the housings, and a cylindrical follower bar having a diameter substantially equal to a diameter of the corresponding plug. Each of the housings is releasably engageable with the mounting block at each of the plurality of sections.

24 Claims, 10 Drawing Sheets

(56) References Cited

U.S. PATENT DOCUMENTS

| | | | | | |
|---|---|---|---|---|---|
| 3,664,007 | A * | 5/1972 | Schlage | E05B 17/0004 | 29/271 |
| 4,680,860 | A * | 7/1987 | Detloff | B25B 1/20 | 29/281.1 |
| 4,763,395 | A * | 8/1988 | Fontaine | E05B 17/0004 | 29/253 |
| 5,609,052 | A * | 3/1997 | Denning | E05B 9/04 | 29/464 |
| 5,628,109 | A * | 5/1997 | Neuman | E05B 17/0004 | 29/270 |
| 5,921,122 | A * | 7/1999 | Lin | E05B 27/005 | 70/368 |
| 6,021,655 | A * | 2/2000 | Labbe | E05B 17/0004 | 29/281.1 |
| 7,685,852 | B2 * | 3/2010 | Komemi | E05B 17/0004 | 29/464 |
| 7,685,853 | B2 * | 3/2010 | Burkart | E05B 17/0004 | 29/464 |
| 7,905,124 | B2 * | 3/2011 | Komemi | E05B 19/20 | 29/804 |
| 8,881,567 | B2 * | 11/2014 | Chong | E05B 29/004 | 29/804 |
| 2014/0260460 | A1 * | 9/2014 | Ohl | E05B 17/0004 | 70/447 |

* cited by examiner

LOCK RE-PINNING ASSEMBLY

CROSS-REFERENCE TO RELATED APPLICATIONS

The present application claims the benefit of U.S. Provisional Patent Application No. 61/953,729 filed on Mar. 14, 2014, the contents of which are incorporated herein by reference in their entirety.

TECHNICAL FIELD

The present disclosure generally relates to lock cylinders, and more particularly but not exclusively relates to assemblies for use in re-pinning lock cylinders.

BACKGROUND

Re-pinning a lock cylinder can pose certain difficulties. Persons that are inexperienced or inattentive to the task may unintentionally eject one or more pins that are not intended to be removed. This can result in a difficult and time consuming task that the consumer often foregoes in favor of returning the disassembled lock to the manufacturer as damaged goods. These issues may be of particular concern to lock manufacturers to whom an otherwise operational lock cylinder may be returned as a damaged product. Therefore, a need remains for further improvements in this technological field.

SUMMARY

An exemplary lock re-pinning assembly includes two or more housings and a mounting block. Each housing is configured for use with a corresponding one of a plurality of lock cylinder shells. Each of the housings includes a cylindrical chamber and a channel. The chamber is configured to receive the body of the corresponding shell, and the channel is configured to receive the tower of the corresponding shell. The mounting block includes a mounting block having two or more sections. Each section is configured for use with a corresponding one of a plurality of lock cylinder plugs. Each section includes a cavity configured to receive an end of at least one of the housings, and a cylindrical follower bar having a diameter substantially equal to a diameter of the corresponding plug. Each of the housings is releasably engageable with the mounting block at each of the plurality of sections.

DETAILED DESCRIPTION OF ILLUSTRATIVE EMBODIMENTS

Figure 1:
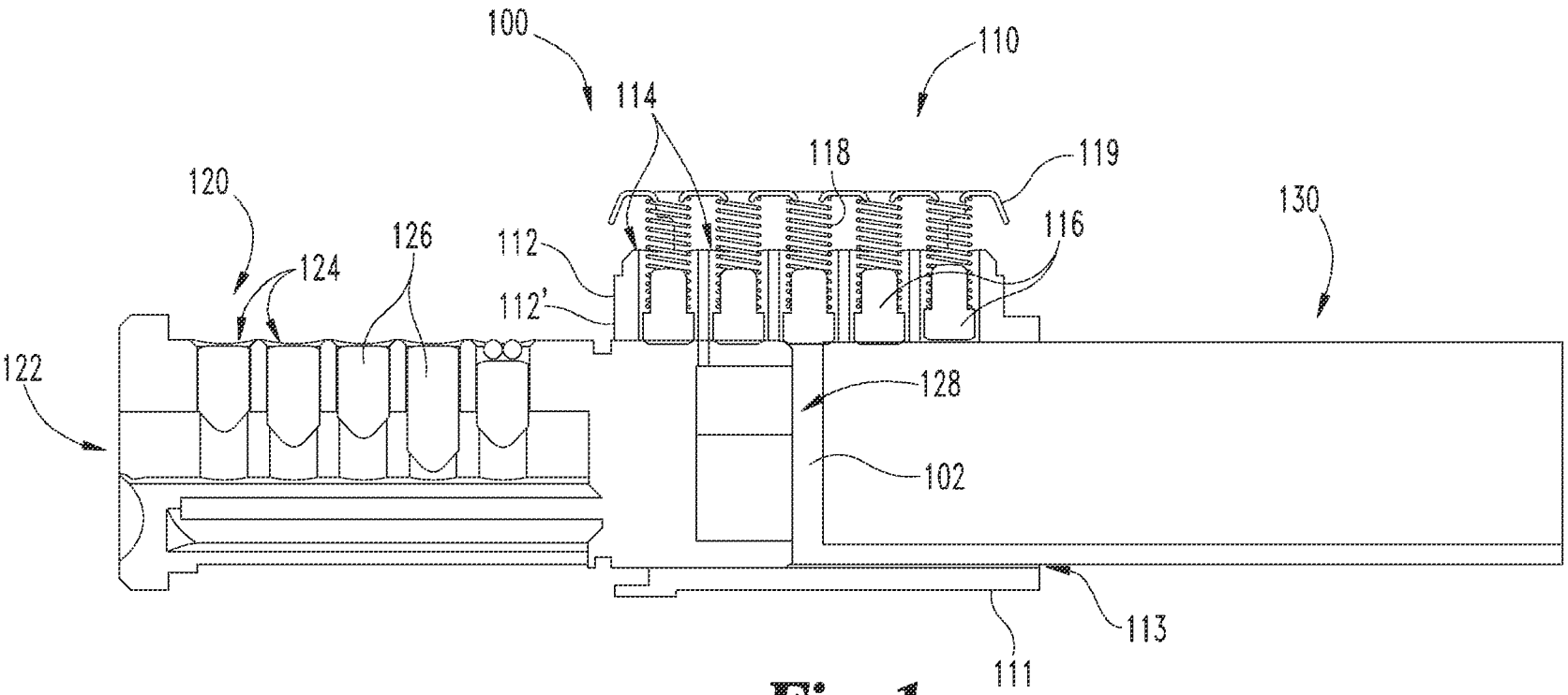
Fig. 1 (PRIOR ART)
FIG. 1 depicts a lock cylinder and follower bar during a conventional re-pinning operation.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, a lock cylinder 100 and follower bar 130 are illustrated during a conventional re-pinning operation. The lock cylinder 100 includes a shell 110 defining a cavity 113, and a plug 120 seated in the cavity 113. The shell 110 includes a body portion 111 in which the cavity 113 is formed. The shell 110 also includes a tower 112 which extends from a tower base 112' connected to the body portion 111. The tower 112 defines a plurality of top pin chambers 114, and a plurality of driving or top pins 116 are positioned in the top pin chambers 114. The lock 100 also includes a plurality of springs 118 which bias the top pins 116 toward the plug 120, and may further include a cap 119 to prevent the springs 118 and the top pins 116 from exiting the tower 112 in a radially outward direction.

The lock plug 120 includes a keyway 122, a plurality of bottom pin chambers 124, and a plurality of driven or bottom pins 126 positioned in the bottom pin chambers 124. When a key is inserted into the keyway 122, the key urges the bottom pins 126 radially outward, and the bottom pins 126 urge the top pins 116 into the tower 112. If the key is a proper key, ends of the top and bottom pins 116, 126 align with a shear line between the plug 120 and the shell 110, thereby enabling rotation of the plug 120.

In order to re-pin the cylinder 100, the plug 120 must be removed from the shell 110 such that one or more of the bottom pins 126 can be replaced and/or rearranged for recombinating. When the plug 120 is removed from the shell 110, the springs 118 will tend to eject the top pins 116 from the shell chambers 114 and into the cavity 113. This ejection of the top pins 116 is sometimes referred to as "exploding", and the resulting state of the cylinder 100 is often referred to as a "blown" condition.

In an effort to prevent the cylinder 100 from exploding, certain conventional re-pinning operations include inserting the follower bar 130 into the shell 110 as the plug 120 is removed, such that the follower bar 130 takes the place of the plug 120 and retains the top pins 116 within the tower 112. The follower bar 130 may be inserted into the shell 110 at the same rate as the lock plug 120 is removed from the shell 110, such that a contacting interface between the follower bar 130 and an end 128 of the plug 120 is maintained as the plug 120 slides out of the cavity 113. If the person performing the re-pinning operation is inexperienced or inattentive to the task of inserting the follower bar 130, a gap 102 may form between the follower bar 130 and the plug 120. When the gap 102 occurs, one or more of the top pins 116 may be ejected from the pin chambers 114 and into the gap 102, thereby resulting in a blown condition of the cylinder 100. Without proper training and locksmith tools, the task of properly reassembling a cylinder 100 in the blown condition may be difficult and time consuming operation.

Figure 2:
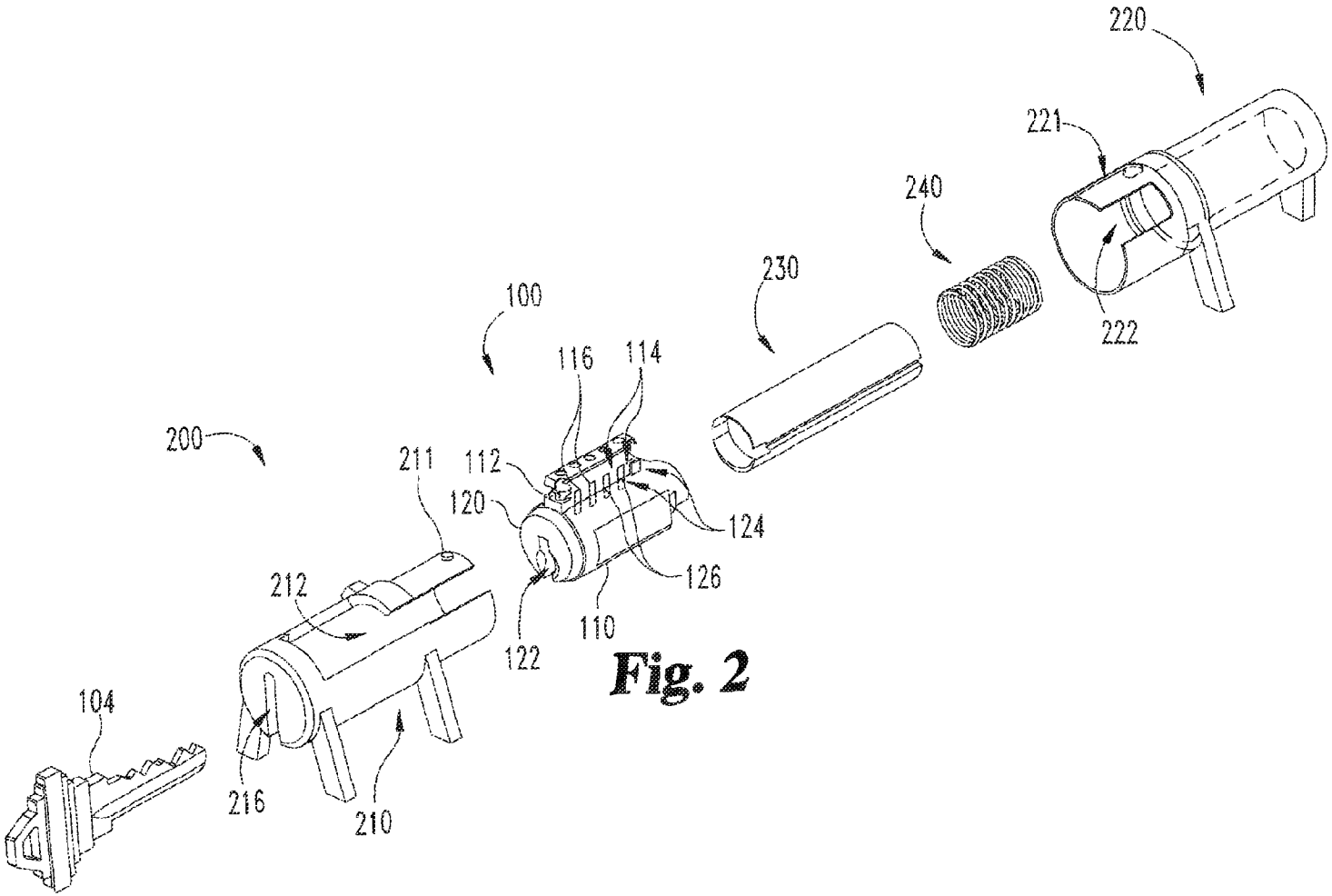
FIG. 2 is an exploded assembly view of a lock cylinder with a lock re-pinning assembly according to a first embodiment.
Figure 3:
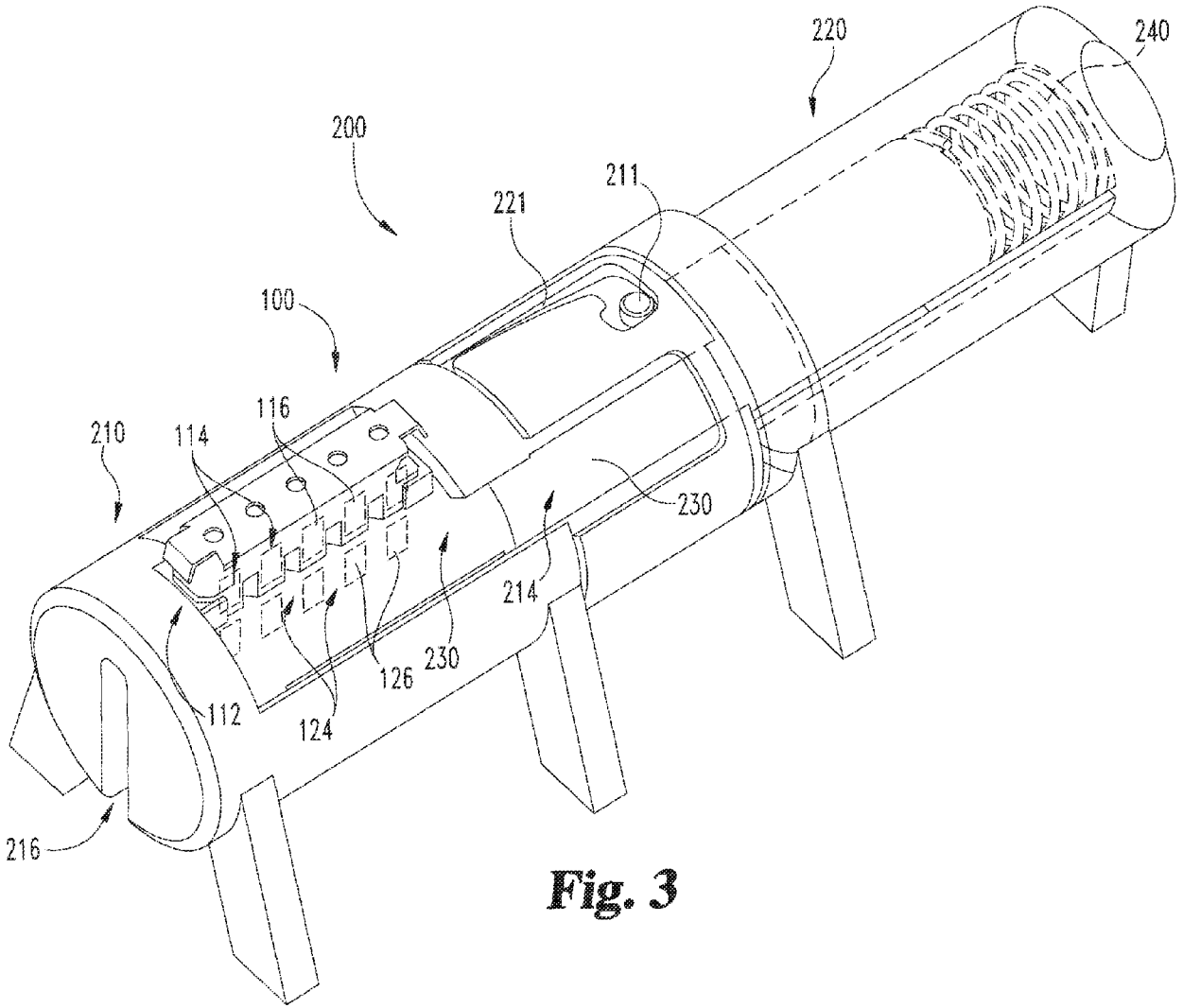
FIG. 3 depicts the lock re-pinning assembly illustrated in FIG. 2, as assembled with the lock cylinder in a first configuration.
Figure 4:
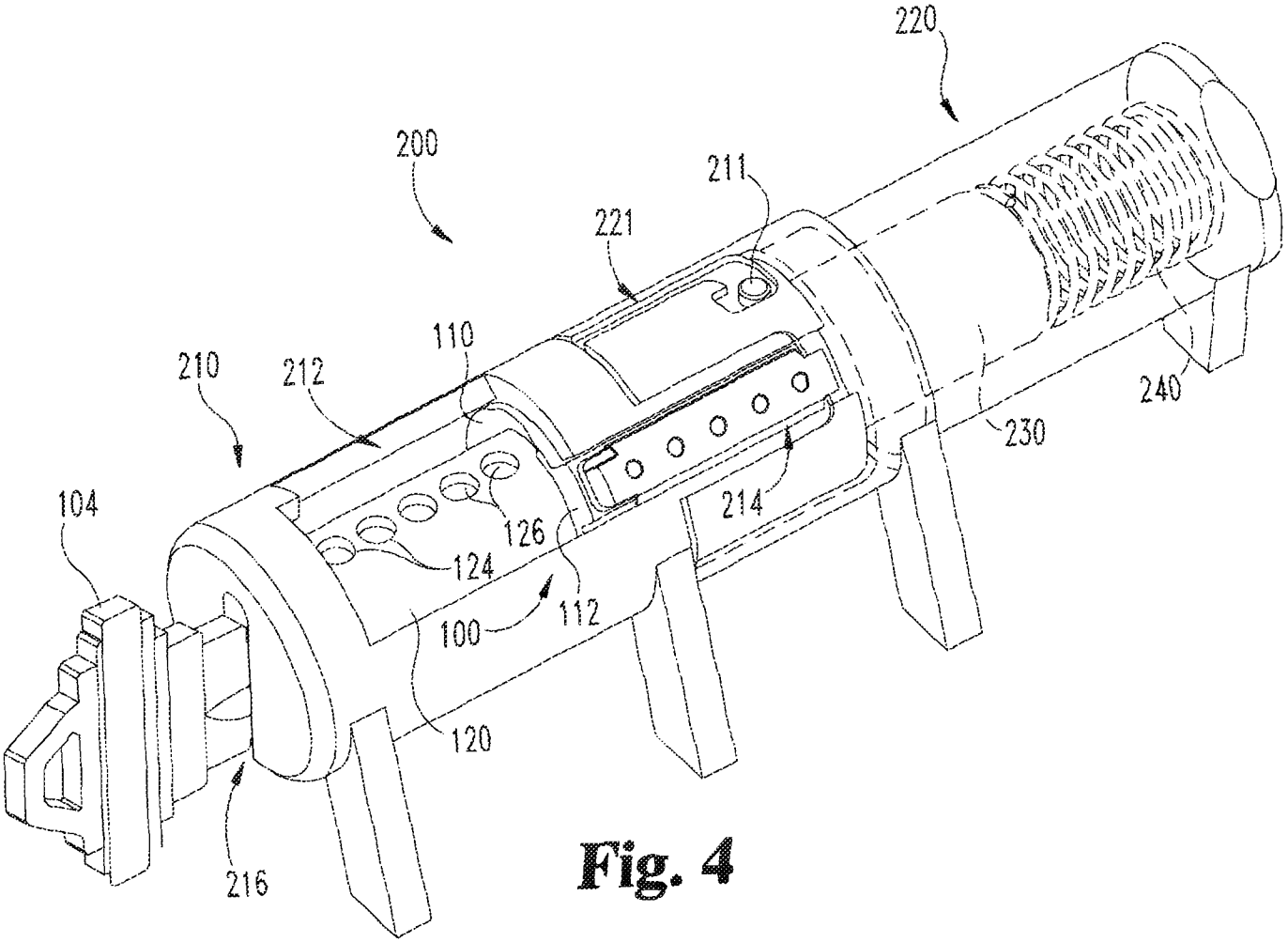
FIG. 4 depicts the lock re-pinning assembly illustrated in FIG. 2, as assembled with the lock cylinder in another configuration.

FIGS. 2-4 illustrate the lock cylinder 100 and an exemplary lock re-pinning assembly 200 in a variety of configurations. The re-pinning assembly 200 may be of the type described in commonly-owned U.S. patent application Ser. No. 14/214,494 filed Mar. 14, 2014, the contents of which are hereby incorporated herein by reference in their entirety. As illustrated in FIG. 2, the lock re-pinning assembly 200 includes a front housing 210, a rear housing 220 operable to receive a portion of the front housing 210, a follower bar 230, and a biasing element such as a spring 240.

FIG. 3 illustrates the assembled lock re-pinning assembly 200 with the lock cylinder 100 in a first configuration. In the first configuration, the lock cylinder 100 is still substantially assembled, with the top and bottom pins 116, 126 captured or contained by the shell 110 and the plug 120. The lock cylinder 100 is positioned in the front housing 210, and the follower bar 230 and spring 240 are positioned primarily in the rear housing 220. The housings 210, 220 are releasably coupled to one another such as, for example, via bayonet attachment features, depicted herein as a post 211 and a hooked channel 221. However, it is also contemplated that additional or alternative mounting or joining features may be used.

When the lock re-pinning assembly 200 is assembled with the lock cylinder 100, the lock cylinder 100, the follower bar 230, and the spring 240 are retained within the front and rear housings 210, 220. The follower bar 230 is positioned between the lock cylinder 100 and the spring 240 such that the spring 240 biases the follower bar 230 against the lock plug 120 to prevent formation of a gap. This biasing force effectively couples the lock plug 120 and follower bar 230 such that the lock plug 120 and follower bar 230 are stationary with respect to one another. As a result, any axial movement of the lock plug 120 within the assembly 200 may be mimicked by the follower bar 230, thereby maintaining tight contact or engagement between the two elements.

FIG. 4 depicts the assembled lock re-pinning assembly 200 with the lock cylinder 100 in another configuration. The front housing 210 is provided with an opening 216 to allow a key 104 to be inserted through the front housing 210 and into the plug 120. When inserted, the key 104 retains the lock plug 120 at a fixed rotational position, thereby maintaining the plug 120 properly aligned and substantially stationary within the assembly 200. Additionally, when the key 104 is inserted, the pins 116, 126 are aligned with a shear line of the cylinder 100 such that the shell 110 is rotationally and axially movable with respect to the plug 120. The front and rear housings 210, 220 may have respective openings 212, 222 to accommodate the tower 112 as the shell 110 rotationally and axially moves with respect to the plug 120. When the housings 210, 220 are joined together, the openings 212, 222 form a channel 214 operable to receive the tower 112 such that the shell 110 is axially movable with respect to the assembly 200.

In order to perform the re-pinning operation, the lock cylinder 100 is placed in the front housing 210, preferably in a locked state to keep the lock cylinder 100 in an assembled configuration. With the follower bar 230 and spring 240 positioned in the rear housing 220, the two housings 210, 220 may be joined or mounted together and secured with the bayonet attachment features 211, 221. The lock cylinder 100 is placed in a first configuration (FIG. 3) including a first plug position and a first shell position. In the illustrated first cylinder configuration, the shell 110 is positioned on the plug 120, the tower 112 is substantially vertical, and the plug keyway 122 is aligned with the opening 216. While the lock cylinder 100 is still locked in this first configuration, the top and bottom pins 116, 126 are retained in the respective chambers 114, 124, and the pin springs 118 bias the top pins 116 against the bottom pins 126.

When the lock cylinder 100 is in the first configuration, the key 104 may be inserted into the plug 120 through the opening 216. When the key 104 is inserted, the pins 116, 126 align with the shear line of the lock cylinder 100, thereby allowing the shell 110 to rotate with respect to the plug 120. The cylinder 100 may then be placed in a second configuration by rotating the shell 110 about the lock plug 120 to a second shell position, all while the plug 120 remains in the first plug position. In the illustrated embodiment, the second shell position is offset from the first shell position by approximately 45°, although other offset angles are contemplated. When the shell 110 is in the second shell position, the top pins 116 are captured within the pin chambers 114 and are biased into contact with the outer surface of the lock plug 120 via the springs 118. Additionally, the bottom pins 126 are retained within the pin chambers 124 between the key 104 and the shell 110.

Once the shell 110 has been rotated to the second position, the tower 112 is aligned with the channel 214 and the shell 110 is axially movable with respect to the plug 120. The cylinder 100 may then be placed in a third configuration (FIG. 4) by pushing the shell 110 toward the rear housing 220 such that the shell 110 axially moves to a third shell position. As the shell 110 moves from the second shell position to the third shell position, the shell 110 slides off of the plug 120 and onto the follower bar 230. Because the spring 240 biases the follower bar 230 against the lock plug 120, the shell 110 may move from the second shell position to the third shell position without any of the top pins 116 being ejected from their respective pin chambers 114. In the third shell position, the top pins 116 are retained within their respective pin chambers 114 between the springs 118 and the follower bar 230.

With the shell 110 in the third shell position, the bottom pin chambers 124 and the pins 126 are exposed. The user may then remove the bottom pins 126 and the key 104 from the plug 120. With the plug 120 empty, a new key 104 may be inserted into the plug 120, and a corresponding set of new bottom pins 126 may be inserted into the bottom pin chambers 124. Due to the fact that the new set of bottom pins 126 corresponds to the new key 104, the ends of the bottom pins 126 will be aligned with the outer surface of the plug 120. Once the bottom pins 126 have been replaced, the above-described steps may be followed in reverse order to reassemble the newly re-pinned lock cylinder 100.

It should be appreciated that the outer edges and general cross-sectional profile of the follower bar 230 and the lock plug 120 may be substantially congruent to provide a smooth transition for the top pins 116 as they travel along the outer surfaces of the plug 120 and the follower bar 230, such that the top pins 116 are retained within the top pin chambers 114. In addition, the outer diameter OD of the follower bar 230 may correspond to the inner diameter ID of the shell 110, thereby enabling the shell 110 to easily and smoothly translate over and along the follower bar 230 without interference. When the assembly 200 is assembled with the lock cylinder 100, the lock plug 120 and the follower bar 230 may share a common longitudinal axis such that the two parts work in unison to maintain alignment of the shell 110 with respect to the lock plug 120 throughout the re-pinning process.

Figure 5:
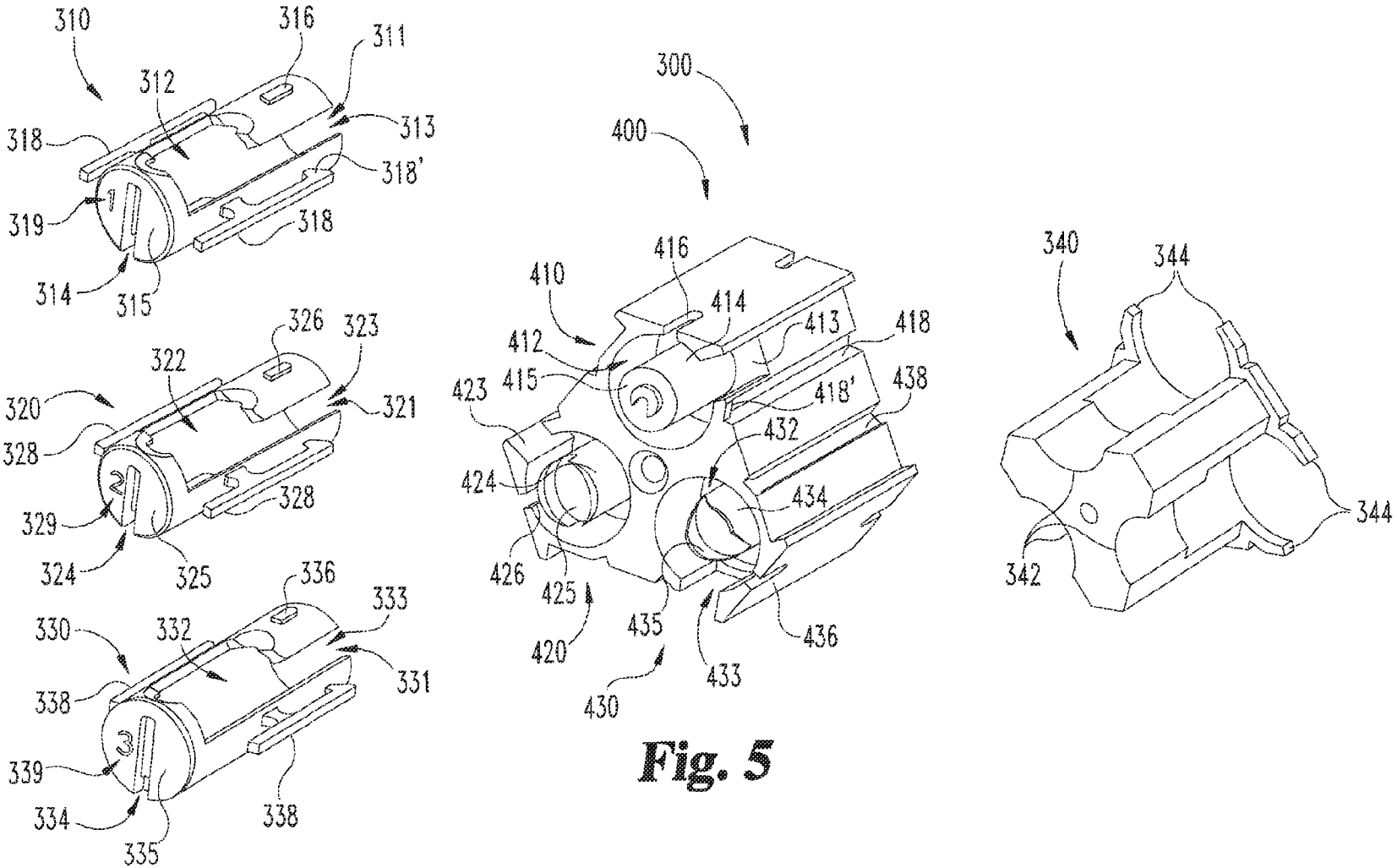
FIG. 5 is an exploded assembly view of a lock re-pinning assembly according to a second embodiment.
Figure 6:
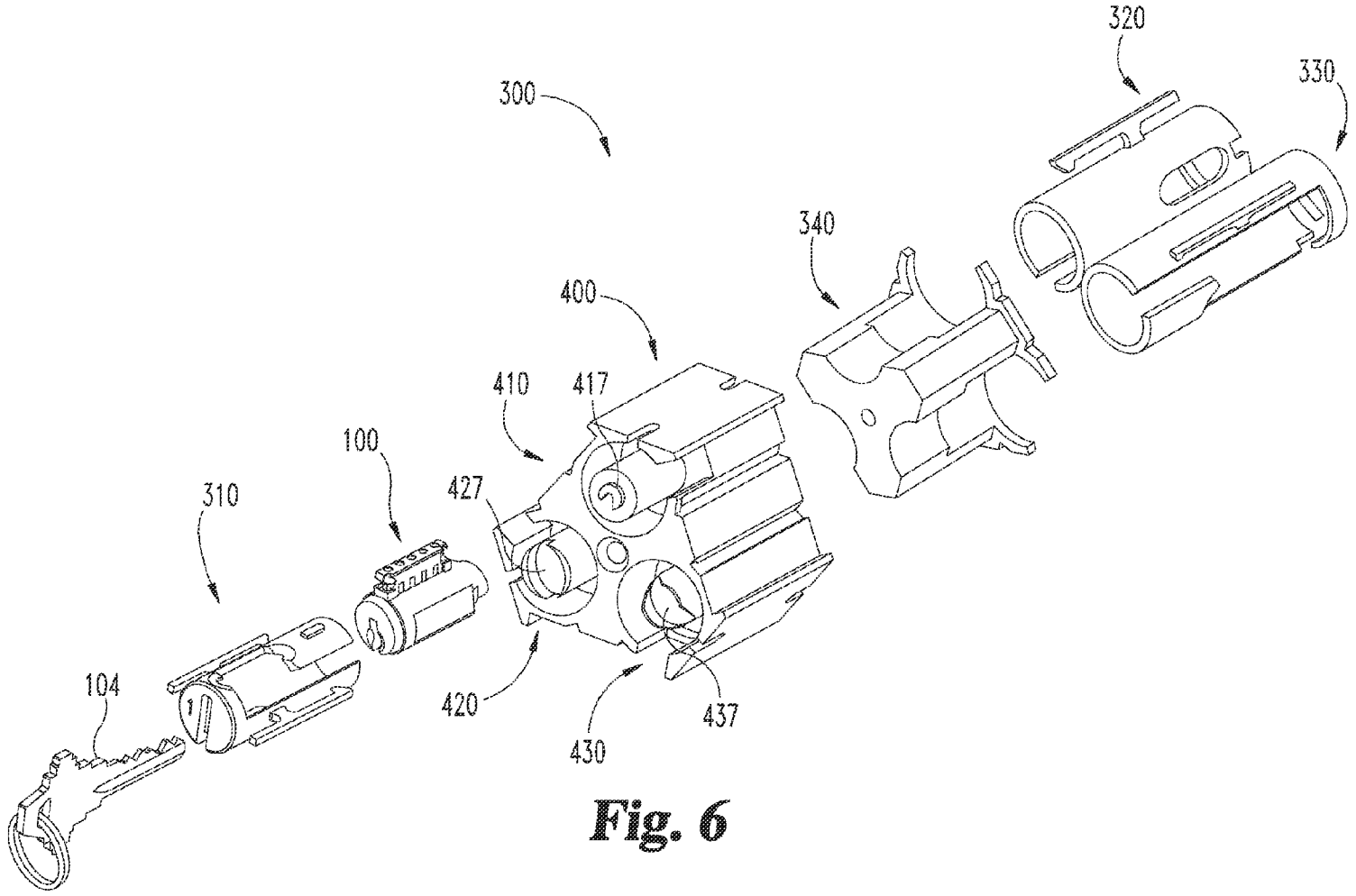
FIG. 6 is an exploded assembly view of the lock re-pinning assembly illustrated in FIG. 5 with a lock cylinder.

FIGS. 5 and 6 illustrate an exploded view of a second exemplary re-pinning assembly 300. The assembly 300 includes a plurality of housings 310, 320, 330 and a mounting block 400 including a plurality of sections 410, 420, 430. The assembly 300 may further include a counterweight 340 releasably coupled to the mounting block 400. The assembly 300 is configured for use with plurality of configurations of lock cylinders such that the assembly 300 can be used to re-pin lock cylinders having a variety of different formats or configurations.

The housing 310 is substantially cylindrical, and is configured to receive a lock shell of a corresponding format or configuration. For example, the housing 310 may be configured to receive the lock shell 110, or a shell of a similar format or configuration. The housing 310 includes a chamber 311 sized and configured to receive the body of the corresponding shell format such as, for example, the body 111 of the shell 110. The chamber 311 extends from an open first end of the housing 310 toward a partially closed second end of the housing 310. In other words, the chamber 311 extends proximally from the distal end of the housing 310.

The housing 310 also includes a partial circumferential opening 312 having an axial length and an angular span. The axial length of the opening 312 corresponds to the axial length of the tower 112, and the angular span of the opening 312 is such that the shell 110 can rotate between the first and second shell positions described above. In other words, the opening 312 is sized and configured to receive the tower 112, and to enable limited rotational movement of the shell 110 when the tower 112 is received therein. The housing 310 also includes a channel 313 which extends proximally from the distal end of the housing 310 and connects to the opening 312. The width of the channel 313 corresponds to the width of the base 112' of the tower 112 such that the tower 112 can travel through the channel 313 and into the opening 312 as the cylinder 100 is inserted into the housing 310.

The second or proximal end of the housing 310 is partially enclosed by a face 315 which includes an opening 314 through which a key may be inserted. The housing 310 may further include one or more alignment features to provide proper alignment of the housing 310 with respect to the mounting block 400. In one form, the alignment features may include a post 316. The housing 310 may further include one or more attachment features by which the housing 310 can be releasably coupled to the mounting block 400 such as, for example, arms 318 including hooks 318'. The housing 310 may further include indicia 319 relating to the shell format corresponding to the housing 310.

Figure 7:
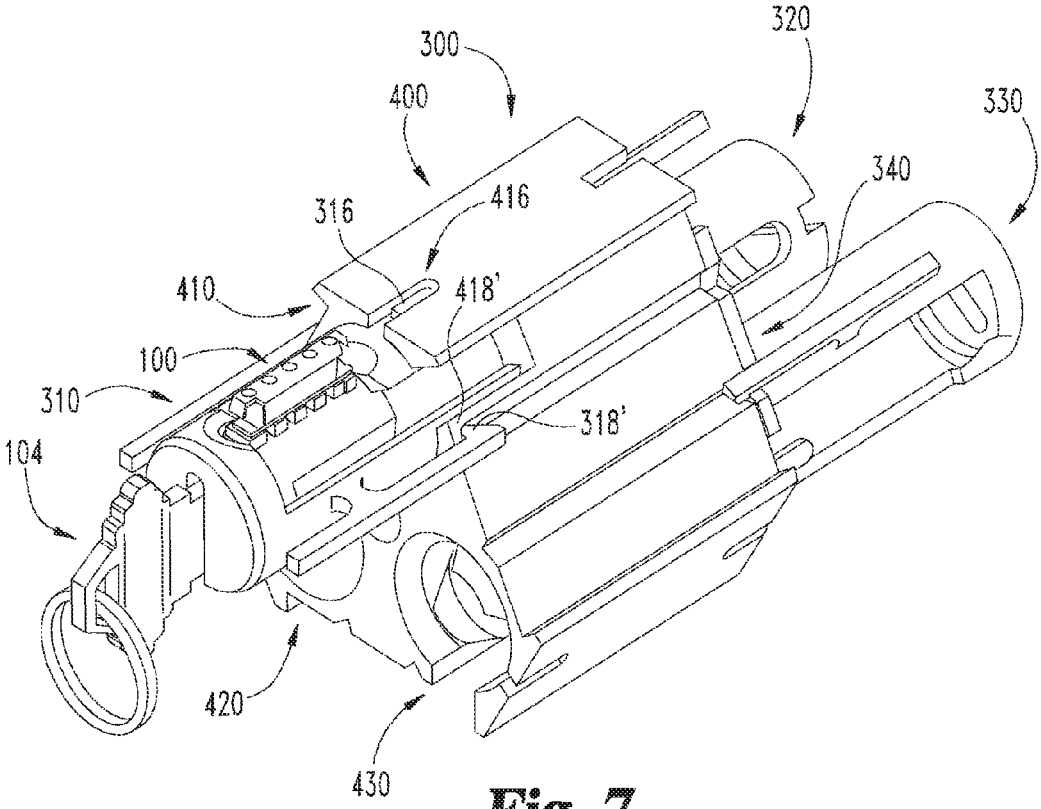
FIG. 7 depicts the re-pinning assembly and lock cylinder illustrated in FIG. 6 in a first stage of a re-pinning operation.
Figure 8:
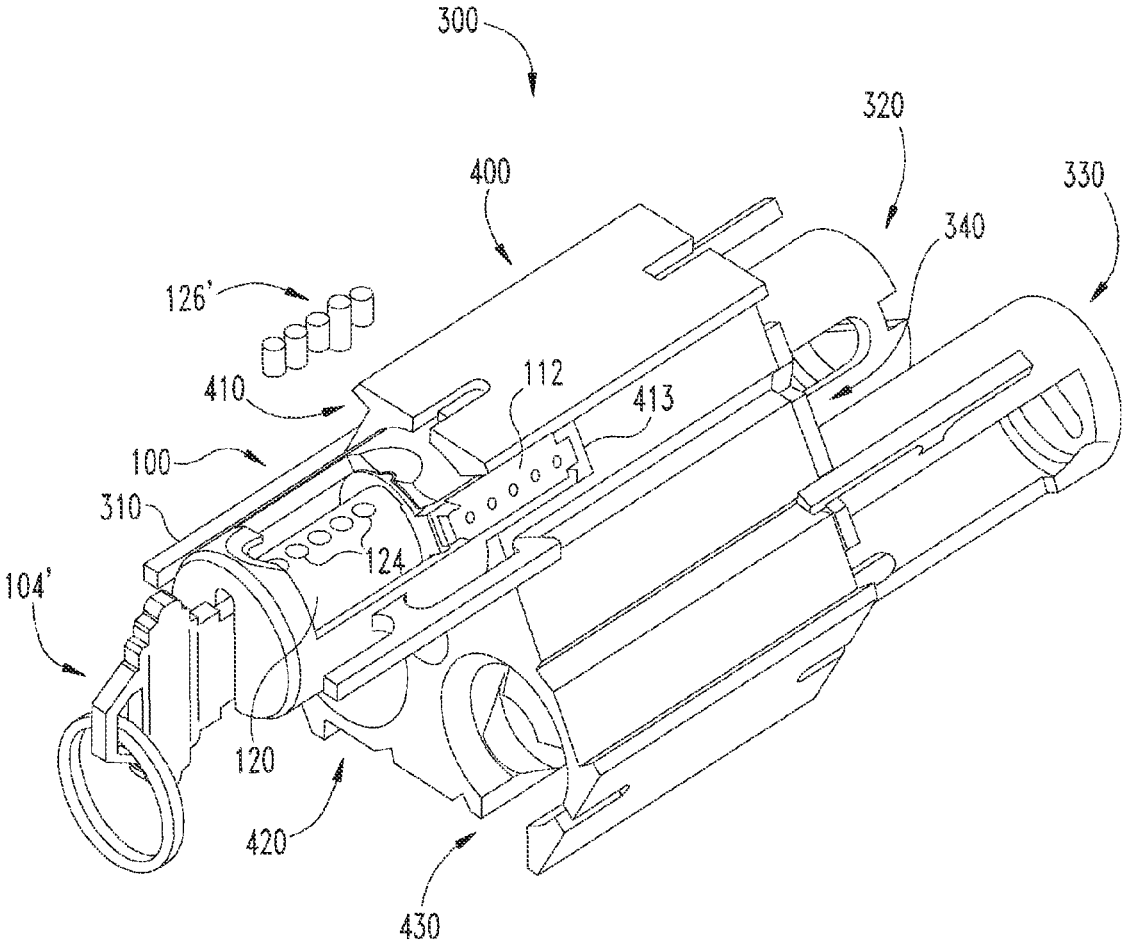
FIG. 8 depicts the re-pinning assembly and lock cylinder illustrated in FIG. 6 in a second stage of the re-pinning operation.

With additional reference to FIGS. 7 and 8, the mounting block 400 includes a plurality of sections 410, 420, 430. The first section 410 includes a substantially cylindrical cavity 412 configured to receive the distal end of the first housing 310, and a channel 413 having a width which may correspond to the width of the channel 313. The first section 410 also includes a follower bar 414 extending proximally into the cavity 412. The follower bar 414 is configured to flushly engage at least a portion of the distal end of the plug 120, and may have a diameter corresponding to that of the plug 120. In various forms, the follower bar 414 may be integrally formed, securely coupled, or releasably coupled to the mounting block 400. The first section 410 may also include an alignment feature such as a slot 416, and may further include an attachment feature such as a groove 418 including a ridge 418'.

As depicted in FIGS. 7 and 8, when the housing 310 is mounted to the mounting block 400 at the first section 410, the channels 313, 413 at least partially overlap, and the follower bar 414 extends into the housing 310. Additionally, the post 316 is received in the slot 416 to provide proper alignment for the housing 310, and the arms 318 engage the grooves 418 to releasably couple the housing 310 to the mounting block 400. For example, the hooks 318' of the arms 318 may engage the ridges 418' of the grooves 418 in a snap-fit manner to releasably secure the housing 310 to the mounting block 400.

With continued reference to FIGS. 5-8, when the assembly 300 is utilized to re-pin the cylinder 100, the re-pinning operation may be performed in a manner substantially similar to that described above with respect to FIGS. 3 and 4. In an exemplary form of a re-pinning operation, the cylinder 100 is placed in the first housing 310 in the first configuration (FIG. 7), and the housing 310 is coupled to the first section 410 in the manner described above. The key 104 may then be inserted into the plug 120 through the opening 314, thereby aligning the pins 116, 126 with the shear line. The cylinder 100 is then placed in the second configuration by rotating the shell 110 to the second shell position, wherein the tower 112 is in turn aligned with the channels 313, 413.

With the cylinder 100 in the second configuration, the user may urge the shell 110 toward the mounting block 400. As the shell 110 slides off of the plug 120 and onto the follower bar 414, the tower 112 enters the aligned channels 313, 413. Additionally, the top pins 116 travel along the outer surface of the plug 120, across an interface between the plug 120 and the follower bar 414, and along the outer surface of the follower bar 414. If there is a gap between the plug 120 and the follower bar 414, one of the pins 116 may be urged into the gap such that the pin 116 is no longer positioned in the tower 112. If this occurs, the pin 116 may prevent the shell 110 from moving to the third shell position. Additionally, if the gap is large enough, the pin 116 may fully eject, thereby resulting in a blown cylinder. In order to prevent such complications, the follower bar 414 may include an end portion 415 having a geometry corresponding to the plug end 128 such that the plug-bar interface provides a smooth transition for the pins 116 traveling across the interface. Further details regarding such a feature are described below.

When the shell 110 reaches the third shell position, the cylinder 100 is in the third configuration (FIG. 8). In the third configuration, the top pins 116 are retained in the tower 112 via the follower bar 414, and the bottom pin chambers 124 and bottom pins 126 are accessible through the opening 312. The key 104 and the bottom pins 126 may then be removed from the plug 120, and a new key 104' may be inserted into the plug 120 through the opening 314. The new key 104' has a different bitting profile or edge cut relative to the previous key 104, and is therefore configured to align a different set of bottom pins 126' with the shear line in the cylinder 100. The new set of bottom pins 126' are inserted into the pin chambers 124 such that the ends of the bottom pins 126' are aligned with the outer surface of the plug 120.

With the new bottom pins 126' seated in the plug pin chambers 124, the shell 110 may be pushed back onto the plug 120 and rotated to the first shell position such that the cylinder 100 is once again in the first configuration. The key 104' may then be extracted from the plug 120, and the housing 310 may be unclipped from the mounting block 400. The newly re-pinned cylinder 100 may then be removed from the housing 310 and reinstalled into a lockset such that the lockset is operable by the new key 104'.

The second and third housings 320, 330 are substantially similar to the first housing 310, and similar reference characters are used to indicate similar elements. In the illustrated form, each of the housings 310, 320, 330 includes substantially similar outer diameters, alignment features (such as the post 316), and engagement features (such as the arms 318). Additionally, each of the sections 410, 420, 430 includes substantially similar inner diameters, alignment features (such as the slot 416), and engagement features (such as the groove 418). As such, each of the housings 310, 320, 330 is operable with each of the sections 410, 420, 430. It is also contemplated that that each of the housings 310, 320, 330 may be operable with only one of the sections 410, 420, 430, or that a subset of the housings 310, 320, 330 may be operable with a subset of the other sections 410, 420, 430.

While other forms are contemplated, the illustrated housings 310, 320, 330 are configured substantially identical to one another, and differ only in the axial length of the partial circumferential openings 312, 322, 332. As noted above, the length of the openings 312, 322, 332 may correspond to the length of the tower of the corresponding shell format. Accordingly, the length of the opening 312 of the first housing 310 may correspond to the length of the tower of a first shell format, and the length of the opening 322 of the second housing 320 may correspond to the length of the tower of a second shell format.

The counterweight 340 may serve a number of functions in the assembly 300. In certain forms, the mounting block 400 may be substantially hollow, and the counterweight 340 may be seated in the hollow portion. In other forms, the counterweight 340 may be integrally formed with the mounting block 400. When positioned in the mounting block 400, the counterweight 340 may counteract torques produced when the housing 310 and the cylinder 100 are attached to the mounting block 400. Thus, the counterweight 340 may balance the assembly 300 to prevent tipping during the re-pinning operation. The counterweight 340 may further include a recesses 342 configured to receive the housings 310, 320, 330, and arms 344 configured to retain the housings 310, 320, 330 within the mounting block 400. In other words, the counterweight 340 may provide a place to store the housings that are not currently being used, thereby discouraging the housings from being separated from the rest of the assembly 300.

Figure 9:
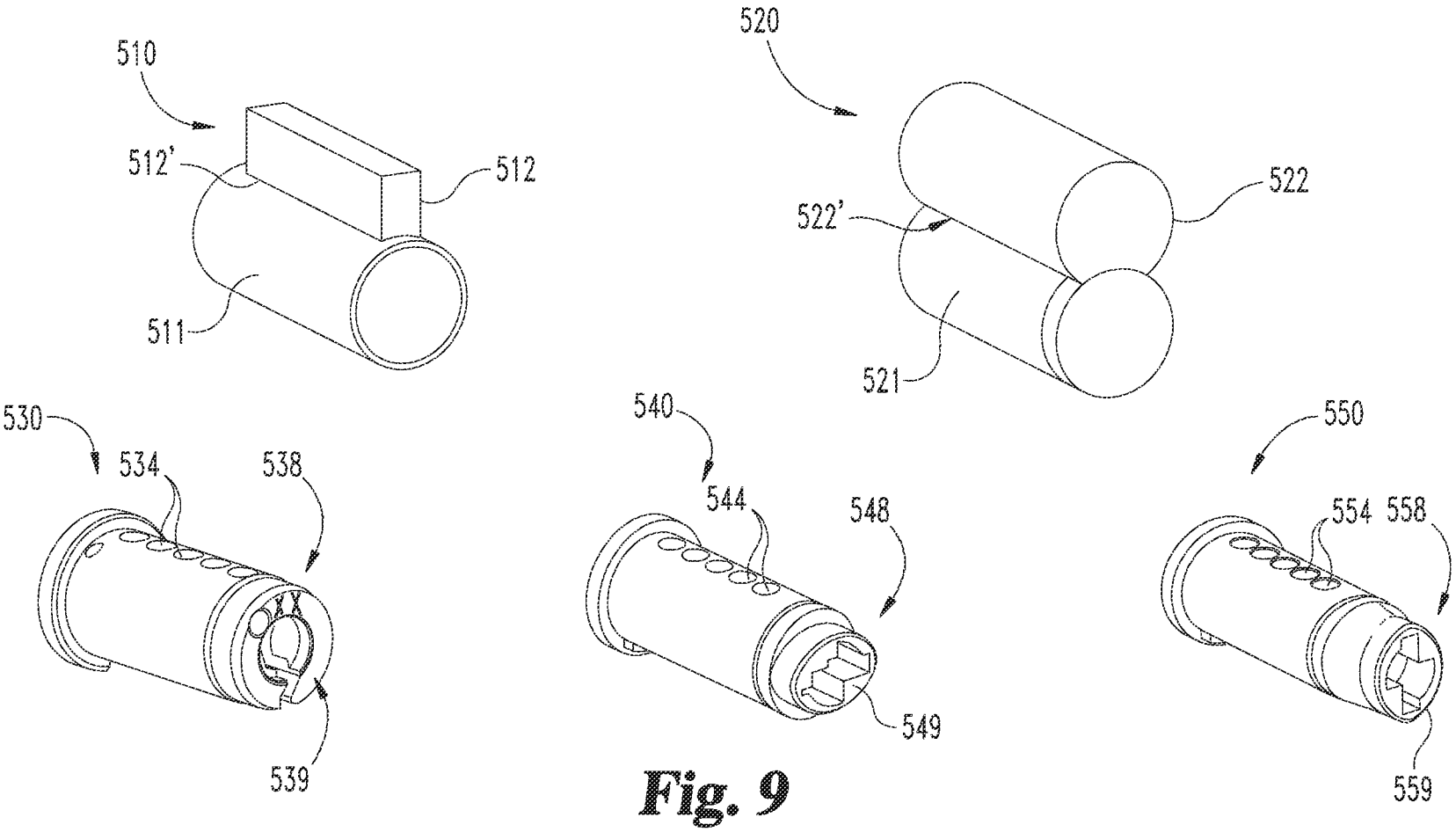
FIG. 9 depicts a plurality of shells and plugs having a variety of exemplary formats.

With additional reference to FIG. 9, a variety of exemplary shells 510, 520 and plugs 530, 540, 550 of varying formats are illustrated. The exemplary shells and plugs may be combined to form a lock cylinder such as the cylinder 100. The first shell 510 is a key-in-lever shell, and the second shell 520 is of the type used in small format interchangeable core (SFIC) lock cylinders.

The back ends of each of the illustrated plugs 530, 540, 550 have different configurations, each of which may be configured for use in a particular type of lockset. For example, the end 538 of the first plug format 530 has a generally circular recess 539. The first plug format 530 may, for example, be utilized in lock cylinders configured for use with dead bolts, handle sets and/or electronic locks. The end 548 of the second plug format 540 includes a generally elliptical protrusion 549, the longitudinal axis of which is arranged substantially parallel with the pin chambers 544. The second plug format 540 may, for example, be utilized in a lock cylinders configured for installation in a knob. The end 558 of the third plug format 550 includes a generally elliptical protrusion 559, the longitudinal axis of which is arranged substantially perpendicular to the pin chambers 554. The third plug format 550 may, for example, be utilized in a lock cylinder configured for installation in a lever.

While the first housing 310 is operable with shells having a configuration similar to the shell 110, the second and third housings 320, 330 may be configured to receive shells of another format. For example, the second housing 320 may be configured to receive the key-in-lever shell 510. In such a configuration, the dimensions of the opening 322 and channel 323 may correspond to the dimensions of the key-in-lever tower 512, and the indicia 329 may relate to the corresponding shell format 510. The third housing 330 may be configured to receive the SFIC shell 520. In such a configuration, the dimensions of the opening 332 and channel 333 may correspond to the dimensions of the small format tower 522, and the indicia 339 may correspond to the shell format 520. As noted above, each of the housings may differ only in the axial length of the partial circumferential openings. In such configurations, each of the housings may be configured to receive both key-in-lever and SFIC towers, so long as the tower is of an appropriate length.

Similarly, each of the sections of the mounting block 400 may be configured for use with a particular format of plug. For example, each of the follower bar end portions may have a geometry with is configured to mesh with or flushly engage the back or distal end of one of the plug formats. The meshing or flush engagement may ensure proper contact between the front or proximal end of the follower bar and the distal end of the corresponding plug during a re-pinning operation such as that described above.

By way of example, the first section 410 may be configured for use with the first format plug 530, and the end portion 415 of the first follower bar 414 may include a protrusion 417 sized and configured to be received in the circular recess 539. The second section 420 may be configured for use with the second plug format 540, and the end portion 425 of the follower bar 424 may include an elliptical recess 427 sized and configured to receive the elliptical protrusion 549. The third section 430 may be configured for use with the third plug format 550, and the end portion 435 of the follower bar 434 may include an elliptical recess 437 sized and configured to receive the elliptical protrusion 559.

In certain embodiments, the assembly 300 may be configured such that the pin chambers in the plug are oriented vertically during re-pinning operations, thereby facilitating removal and replacement of the driven pins. For example, the mounting block 400 may be operable in a plurality of positions, and in each of the positions a different one of the follower bars may be positioned above and between the other two follower bars. Additionally, the geometries of the follower bar end portions may be provided such that when the back end of the plug is engaged with the end portion of the corresponding follower bar, the pin chambers in the plug are arranged in a vertical orientation.

For example, FIGS. 5-8 illustrates the mounting block 400 in a first rotational position in which the first follower bar 514 is positioned above and between the second and third follower bars 524, 534. With the mounting block 400 in this position and the plug 120 engaged with the first section 410, the plug pin chambers 124 are oriented vertically, as illustrated in FIG. 8. When a plug of another format is engaged with a corresponding one of the other sections, and the corresponding section is positioned above the other two sections, the pin chambers in the plug may similarly be arranged in a vertical orientation.

As can be seen from the foregoing, the exemplary lock re-pinning assembly 300 is operable to re-pin lock cylinders having a wide variety of configurations. For example, if a lock cylinder includes a key-in-lever shell of the first shell format 510 and a plug of the third plug format 550, the mounting block 400 may be oriented such that first and second sections 410, 420 are positioned below the third section 430. The lock cylinder may be placed in the second housing 320 which corresponds to the first shell format 510. The housing 320 may then be mounted to the third section 430 which corresponds to the third plug format 550. With the housing 320 and lock cylinder coupled to the mounting block 400, the re-pinning operation may proceed as described above.

While the illustrated housings are configured to receive the illustrated shells, it should be appreciated that the assembly 300 may include additional or alternative housings configured to receive lock shells of additional or alternative formats. Furthermore, while the illustrated sections include follower bars configured to matingly, meshingly, flushly, or closely engage end portions of the illustrated plugs, it should be appreciated that the assembly 300 may include additional or alternative sections including bars configured to engage end portions of additional or alternative plug formats. As a result, a single assembly 300 can be utilized to re-pin lock cylinders including a wide variety of shells and plugs of varying formats. Given a particular format lock cylinder, the user need only select the housing corresponding to the shell and the section corresponding to the plug. When the cylinder is placed in the housing and the housing is mounted to the mounting block, the assembly supports and aligns the cylinder during the re-pinning process.

Figure 10:
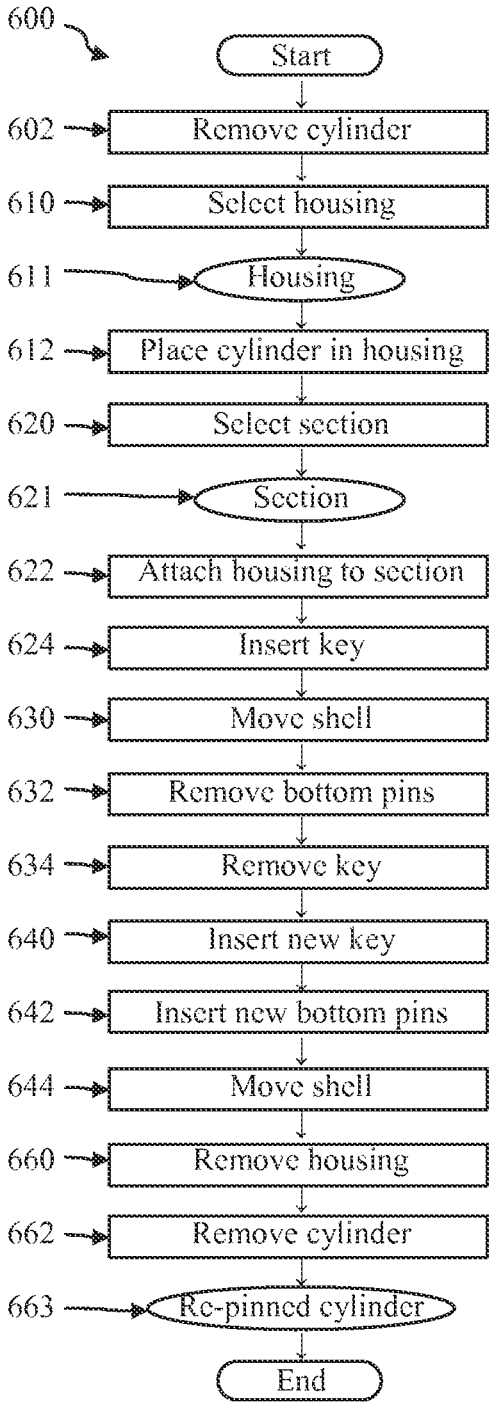
FIG. 10 is a schematic flow diagram of a re-pinning process according to one embodiment.

With reference to FIG. 10, illustrated therein is a schematic flow diagram for an exemplary re-pinning process 600. While the process 600 is described hereinafter with reference to the above-described re-pinning assembly 300 and lock cylinder 100, it should be appreciated that the process 600 may be performed in association with other forms and configurations of a re-pinning assembly and lock cylinders, which may in turn include additional or alternative features. The process 600 may begin with an operation 602 which includes removing from the lockset the lock cylinder to be re-pinned. The operation 602 may also include partially disassembling the lock cylinder as needed to allow removal of the plug from the shell and enable use of the re-pinning assembly 300.

The process 600 may proceed to an operation 610 which includes selecting a housing 611 corresponding to the format of the shell 110 of the lock cylinder 100. For example, the selected housing 611 may be the first housing 310. The process 600 may continue to an operation 612 which includes placing the lock cylinder into the selected housing 611. For example, the operation 612 may include inserting the body 111 of the lock shell 110 into the chamber 311 such that the tower 112 passes through the channel 313 and into the opening 312.

The process 600 may continue to an operation 620, which includes selecting a section 621 corresponding to the format of the plug of the lock cylinder. For example, if the plug is of the first plug format 530, the selected section 621 may be the first section 410. The operation 620 may further include orienting the mounting block 400 such that the selected section 621 is positioned above the remaining sections of the mounting block 400.

With the cylinder 100 mounted in the selected housing 611, the process 600 may continue to an operation 622 which includes attaching the housing 611 to the mounting block 400 at the selected section 621. For example, the operation 622 may include engaging the hooks 318' with the ridges 418'. As a result of the operation 622, the follower bar 414 mates with and supports the distal end of the plug 120. As a result of orienting the mounting block 400 with the selected section 621 above the remaining sections, the driven or bottom pins 126 may be arranged in a substantially vertical orientation, thereby facilitating removal and replacement.

The process 600 also includes an operation 624 which includes inserting the current key 104 to align the pins 116, 126 with the shear line such that shell 110 is movable relative to the plug 120. Once the ends of the pins 116, 126 are aligned with the shear line, the process 600 may continue to an operation 630 which includes moving the shell 110 to expose the bottom pins 126. For example, the operation 630 may include rotating the shell 110 away from home position, and moving the shell body into the mounting block cavity 412 such that the tower 112 extends through the mounting block channel 413. The top pins 116 and springs 118 are retained in the tower 112 via the follower bar 414, thereby preventing the cylinder 100 from exploding.

With the bottom pins 126 exposed, the process 600 may continue to an operation 632 which includes removing the bottom pins 126 from the plug 120. The process 600 may then continue to an operation 634 which includes removing the old key 104 from the plug 120. With the old bottom pins 126 and key 104 removed, the process 600 may continue to an operation 640 which includes inserting a new key 104' with a new bitting code into the plug 120. The process 600 may continue to an operation 642 which includes inserting the new set of bottom pins 126' into the plug pin chambers 124. The new bottom pins 126' correspond to the key code of the new key 104' such that the ends of the new pins 126' align with the outer surface of the plug 120.

With the new bottom pins 126' inserted and aligned with the outer surface of the plug 120, the process 600 may continue to an operation 644 which includes returning the shell 110 to the home position, and may further include extracting or removing the new key 104'. The process 600 may continue to an operation 660 which includes removing the housing 310 from the mounting block 400, and thereafter to an operation 662 which includes removing the re-pinned cylinder 663 from the housing 510. The re-pinned cylinder 663 now has a new key combination, and may be reassembled and re-installed into the lockset.

In one form, a method may include selecting a lock cylinder including a shell, a plug seated in the shell, a plurality of driving pins, and a plurality of driven pins. The shell may have a first shell format selected from a plurality of shell formats, wherein each of the shell formats includes a body and a tower extending from the body. The plug may have a first plug format selected from a plurality of plug formats, wherein each of the plug formats includes a distal end. Additionally, each of the driving pins is positioned at least partially in the tower, and each of the driven pins is positioned at least partially in the plug.

The method may further include selecting a housing from a plurality of housings. Each of the housings may correspond to one of the plurality of shell formats, and each may include a chamber sized and configured to receive the body of the corresponding lock shell format, and a channel sized and configured to receive the tower of the corresponding lock shell format. The selecting the housing may include selecting the housing corresponding to the first shell format.

The method may further include selecting a section of a mounting block, wherein the mounting block includes a plurality of the sections, and each of the sections corresponds to one of the plurality of plug formats. Each of the sections may include a follower bar having an end portion, wherein the end portion is configured to flushly engage at least a portion of the distal end of the corresponding plug format. The selecting the section may include selecting the section corresponding to the first plug format.

The method may further include placing the lock cylinder in the selected housing, coupling the selected housing to the mounting block with the follower bar of the selected section aligned with the plug, and inserting a key into the plug, thereby aligning ends of the driven pins with an outer surface of the plug and enabling movement of the shell with respect to the plug. The method may further include exposing the driven pins. The exposing may include engaging the end portion of the follower bar with the back end of the plug, wherein as a result of the engaging, the follower bar resists axial movement of the plug. The exposing may further include moving the shell toward the mounting block. As a result of the moving, the tower travels along the channel, the follower bar enters the body of the shell and retains the driving pins in the tower, and the driven pins are exposed. The exposing of the driven pins may further include rotating the shell about the plug prior to the moving the shell.

The method may further include removing the key and at least one of the driven pins from the plug, inserting a second key into the plug, and replacing each of the removed driven pins, and wherein as a result of the replacing, an end of each of the driven pins in the plug is aligned with the outer surface of the plug. The method may further include moving the shell away from the mounting block, wherein as a result of the moving, the plug enters the body of the shell, thereby forming a re-pinned lock cylinder, removing the housing from the mounting block, and removing the re-pinned lock cylinder from the housing.

In certain forms, the selected housing further includes an opening, and the placing the lock cylinder in the selected housing includes passing the tower through the channel and rotating the lock cylinder, wherein as a result of the rotating of the lock cylinder, the tower travels along the opening. In certain forms, the tower may travel along the opening and become aligned with the channel as a result of the rotating of the shell about the plug.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A lock re-pinning assembly, comprising:

a plurality of housings, wherein each housing is configured for use with a corresponding one of a plurality of lock cylinder shells, each of the shells includes a cylindrical body and a tower extending from the body, each of the housings including:

a first end and an opposite second end, wherein the first end is open, the second end includes a face, and the face has an opening configured to receive a key;

a cylindrical chamber extending from the first end, the chamber sized and configured to receive the body of the corresponding shell; and a channel extending from the first end, the channel sized and configured to receive the tower of the corresponding shell; and a mounting block including a plurality of sections, wherein each section is configured for use with a corresponding one of a plurality of lock cylinder plugs, each of the sections including:

a cavity configured to receive the first end of at least one of the housings; and a cylindrical follower bar extending into the cavity and having a diameter substantially equal to a diameter of the corresponding plug; and wherein each of the plurality of housings is releasably engageable with the mounting block at each of the plurality of sections.

2. The lock re-pinning assembly of claim 1, wherein each of the housings further includes a partial circumferential opening connected with the channel, wherein the partial circumferential opening is sized and configured to receive the tower of the corresponding shell and to enable limited rotational movement of the corresponding shell when the tower is received therein.

3. The lock re-pinning assembly of claim 1, wherein each of the follower bars includes an end portion configured to flushly engage at least a portion of a back end of the corresponding plug.

4. The lock re-pinning assembly of claim 1, wherein the housings and the mounting block further comprise attachment features, and the attachment features are configured to releasably couple the housings to the mounting block with the first ends received in the cavities.

5. The lock re-pinning assembly of claim 1, wherein each of the housings is releasably coupled to a corresponding one of the sections, the first end of each of the housings is received in the cavity of the corresponding section, and each follower bar projects into the chamber of the corresponding housing.

6. The lock re-pinning assembly of claim 1, wherein the mounting block is a single-piece unitary structure including each of the follower bars.

7. A method of using the lock re-pinning assembly of claim 1, the method comprising:

selecting a lock cylinder including a shell, a plug seated in the shell, a plurality of driving pins, and a first plurality of driven pins, wherein the shell has a first of the plurality of shell formats, and the plug has a first of the plurality of plug formats;

selecting from the plurality of housings a first housing corresponding to the first shell format;

selecting from the plurality of sections a first section corresponding to the first plug format;

positioning the body of the shell in the chamber of the first housing;

aligning a back end of the plug with the follower bar of the first section; and coupling the first housing to the mounting block with the back end of the plug aligned with the follower bar of the first section.

8. An assembly configured for use with each of a plurality of lock cylinder formats, wherein each of the lock cylinder formats includes one of a plurality of shell formats and one of a plurality of plug formats, each of the shell formats includes a cylindrical body and a tower connected to the body at a tower base, and each of the plug formats includes a curved outer surface and a back end, the assembly comprising:

a plurality of housings, wherein each of the housings is configured for use with a corresponding one of the shell formats, each of the housings including:

a distal end and a proximal end, wherein the distal end is open, the proximal end includes a face, and the face has an opening configured to receive a key;

a cylindrical chamber extending proximally from the distal end and sized and configured to receive the body of the corresponding shell format; and a channel extending proximally from the distal end and sized and configured to receive the tower base of the corresponding shell format;

a mounting block including a plurality of sections, wherein each section includes a cavity, and each of the housings is operable to be releasably coupled to each of the sections with the chamber in communication with the cavity; and a plurality of follower bars, wherein each of the follower bars extends proximally into one of the cavities, each of the follower bars is configured for use with a corresponding one of the plurality of plug formats, each of the follower bars including:

a follower surface having curvature corresponding to curved outer surface of the corresponding plug format; and an end portion configured to engage the back end of the corresponding plug format; and wherein, with the end portion engaged with the back end of the corresponding plug format, at least a portion of the curved outer surface is substantially flush with the follower surface.

9. The assembly of claim 8, wherein the follower bars are integrally formed with the mounting block to define a single piece monolithic structure.

10. The assembly of claim 8, wherein each section further comprises a mounting block channel configured to connect to the channel of each of the housings when the housing is coupled to the section.

11. The assembly of claim 8, wherein each of the sections further comprises a first alignment feature, and each of the housings further comprises a second alignment feature configured to engage one of the first alignment features when the housing is coupled to each of the sections.

12. The assembly of claim 11, wherein each of the first alignment features comprises one of a protrusion and a slot, each of the second alignment features comprises the other of the protrusion and the slot, and each of the slots is sized and configured to receive each of the protrusions.

13. The assembly of claim 8, wherein the mounting block has a hollow interior which opens to a distal side of the mounting block, wherein the assembly further comprises a counterweight, and wherein the counterweight is positioned in the hollow interior.

14. The assembly of claim 13, wherein the counterweight includes a plurality of recesses configured to receive the housings, and a plurality of arms operable to releasably couple the housings to the counterweight.

15. The assembly of claim 8, wherein each of the sections includes a ridge, and each of the housings includes a hook configured to engage each of the ridges to releasably couple the housing to the mounting block at each of the sections.

16. An assembly, comprising:

a plurality of housings, including:

a first housing including a first housing attachment feature, a first cylindrical chamber extending proximally from a distal end of the first housing, a first housing channel extending proximally from the distal end of the first housing, and a first partial circumferential opening connected with the first channel, the first partial circumferential opening having a first axial length;

a second housing including a second housing attachment feature, a second cylindrical chamber extending proximally from a distal end of the second housing, a second housing channel extending proximally from the distal end of the second housing, and a second partial circumferential opening connected with the second channel, the second partial circumferential opening having a second axial length different from the first axial length;

a mounting block comprising a plurality of sections, including:

a first section including a first mounting block attachment feature, a first cavity extending distally from a proximal end of the first section, a first section channel extending distally from the proximal end of the first section, and a first follower bar extending proximally into the first cavity, wherein the first follower bar includes a first end portion having a first geometry;

a second section including a second mounting block attachment feature, a second cavity extending distally from a proximal end of the second section, a second section channel extending distally from the proximal end of the second section, and a second follower bar extending proximally into the second cavity, wherein the second follower bar includes a second end portion having a second geometry different from the first geometry;

wherein each of the cavities is sized and configured to receive the distal end of each of the housings;

wherein each of the housing attachment features is configured to engage each of the mounting block attachment features to releasably couple the housings to the mounting block at each of the sections;

wherein, with one of the housings releasably coupled with the mounting block at one of the sections, the channel of the one of the housings is aligned with the channel of the one of the sections;

wherein the first axial length corresponds to an axial length of a tower of a first lock shell format, and the second axial length corresponds to an axial length of a tower of a second lock shell format; and wherein the first geometry is configured to flushly engage a back end of a first lock plug format, and the second geometry is configured to flushly engage a back end of a second lock plug format.

17. The assembly of claim 16, wherein the first geometry includes a protrusion sized and configured to be received in a circular recess formed in the back end of the first lock plug format, and the second geometry includes a recess sized and configured to receive an elliptical protrusion formed in the back end of the second lock plug format.

18. The assembly of claim 16, wherein each of the housing channels has a first angular span, and each of the partial circumferential openings has second angular span greater than the first angular span.

19. The assembly of claim 16, wherein the plurality of housings further includes a third housing including a third housing attachment feature, a third cylindrical chamber extending proximally from a distal end of the third housing, a third housing channel extending proximally from the distal end of the third housing, and a third partial circumferential opening connected with the third channel, the third partial circumferential opening having a third axial length different from the first axial length and the second axial length;

wherein the mounting block further comprises a third section including a third section including a third mounting block attachment feature, a third cavity extending distally from a proximal end of the third section, a third section channel extending distally from the proximal end of the third section, and a third follower bar extending proximally into the third cavity, wherein the third follower bar includes a third end portion having a third geometry different from the first and second geometries;

wherein the third axial length corresponds to an axial length of a tower of a third lock shell format; and wherein the third geometry is configured to flushly engage a back end of a third lock plug format.

20. The assembly of claim 19, wherein each of the housings is substantially identical to each of the other housings, and the housings differ substantially only in the axial lengths of the respective partial circumferential openings.

21. The assembly of claim 19, wherein each of the sections is substantially identical to each of the other sections, and the sections differ substantially only in the geometries of the end portions.

22. The assembly of claim 19, wherein the follower bars of the first, second, and third sections form a triangular pattern, wherein the mounting block has a first position in which the first follower bar is positioned above and between the second and third follower bars, a second position in which the second follower bar is positioned above and between the first and third follower bars, and a third position in which the third section is positioned above and between the first and second follower bars.

23. The assembly of claim 22, wherein each of the plug formats further includes a plurality of pin chambers;

wherein the first geometry is configured to flushly engage the back end of the first plug format when the mounting block is in the first position and the pin chambers of the first plug format are substantially vertical;

wherein the second geometry is configured to flushly engage the back end of the second plug format when the mounting block is in the second position and the pin chambers of the second plug format are substantially vertical; and wherein the third geometry is configured to flushly engage the back end of the third plug format when the mounting block is in the third position and the pin chambers of the third plug format are substantially vertical.

24. The assembly of claim 16, further comprising a lock cylinder including a shell having the first shell format and a plug having the first plug format;

wherein the first housing is releasably coupled to the first section of the mounting block;

wherein a body of the shell is received at least partially in the first cavity, and the tower of the shell is received in the first section channel;

wherein the back end of the plug is flushly engaged with the first geometry of the first end portion;

wherein the plug includes a plurality of pin chambers, and the pin chambers are exposed.

* * * * *